US007524080B2

(12) United States Patent
Tu et al.

(10) Patent No.: US 7,524,080 B2
(45) Date of Patent: Apr. 28, 2009

(54) ILLUMINATION ASSEMBLY

(75) Inventors: Hsi-Ku Tu, Taipei Hsien (TW); Sheng-Ping Hou, Taipei Hsien (TW); Pin-Chun Chen, Taipei Hsien (TW); Tsung-Ting Sun, Taipei Hsien (TW)

(73) Assignee: Edison Opto Corporation, Taipei Hsien (TW)

( * ) Notice: Subject to any disclaimer, the term of this patent is extended or adjusted under 35 U.S.C. 154(b) by 186 days.

(21) Appl. No.: 11/785,020

(22) Filed: Apr. 13, 2007

(65) Prior Publication Data

US 2008/0253113 A1 Oct. 16, 2008

(51) Int. Cl.
*F21L 13/00* (2006.01)

(52) U.S. Cl. ..... 362/183; 362/640; 362/227; 362/800

(58) Field of Classification Search ..... 362/640, 362/652, 183, 800
See application file for complete search history.

(56) References Cited

U.S. PATENT DOCUMENTS 6,641,283 B1 * 11/2003 Bohler ..... 362/238
7,070,294 B2 * 7/2006 Patti ..... 362/153.1
7,410,269 B2 * 8/2008 Harrity et al. ..... 362/101
2004/0184263 A1 * 9/2004 Patti ..... 362/145
2008/0091250 A1 * 4/2008 Powell ..... 607/90
2008/0192461 A1 * 8/2008 Chien ..... 362/183

* cited by examiner

*Primary Examiner*—Ali Alavi
(74) *Attorney, Agent, or Firm*—Birch, Stewart, Kolasch & Birch, LLP

(57) ABSTRACT

An illumination assembly comprises a base and at least one illumination cell. The base comprises a supply circuit for supplying an external power after connecting to a power source. The illumination cell is optionally connected to the base or removed from thereof, and includes a power storage unit stored with a storage power, a discharging circuit, and a charging circuit, wherein the power storage unit is electrically connected to the discharging circuit and the charging circuit. When the illumination cell is removed from the base, the storage power released from the power storage unit drives the illumination cell projecting an illumination light beam via the discharging circuit. When the illumination cell is assembled to the base, the supply circuit is electrically connected to the discharging circuit and the charging circuit respectively, so that the external power can drive the illumination cell projecting the illumination light beam and charge the power storage unit simultaneously.

19 Claims, 8 Drawing Sheets

ILLUMINATION ASSEMBLY

FIELD OF THE INVENTION

The present invention relates to an illumination assembly, and more particularly to an illumination assembly capable of charging and serving in a removed situation or an assembled situation.

BACKGROUND OF THE INVENTION

In daily life, for exactly identifying environment and directions in the dark, illumination devices have already been sorts of indispensable tools. In most existed illumination devices, it is necessary for the illumination devices to assemble the lighting elements to a fixed type of light fixtures, and then the illumination devices can provide the function of illumination after being driven by proper power. While, such illumination devices can be used in the way of fix-type illumination only, but cannot be used in portable-type or versatile-type of illumination.

After that, for making these illumination device being portable, the lighting elements are assembled to a portable shell to be a portable illumination device, such as a flashlight, a headlight, and so on. Although the portable illumination devices bring the convenience of carrying, they are just able to be used in specified usages, such as that the flashlights are used in the field of hand-held illumination, and the headlights are used to provide illumination by fixing the head strap to the head or the waist portion of the human body.

Since these portable illumination devices can just be used in specified usages, but cannot be fixed to different kinds of fixtures, thus an illumination cell capable of attaching to many different kinds of fixtures is developed. Following up, we will provide simple descriptions of the structure of the illumination cell.

Please refer to FIG. 1, which illustrates a sectional view of a conventional illumination cell. As shown in FIG. 1, an illumination cell 1 comprises a shell 11, an illumination opening 12, a light-transmissible element 13, a circuit board 14, a battery 15, a light emitting diode (LED) 16, and an adhesive element 17. The illumination opening 12 is formed on the shell 11. The circuit board 14 is arranged within the shell 11, and arranged with a supply circuit (not shown in FIG. 1). The battery 15 and the LED 16 are electrically connected with the supply circuit. The adhesive element 17 is attached on an outer surface of the shell 11 opposite to the illumination opening 12. Besides, a battery lid (not shown in FIG. 1) also can be provided to cover a battery opening (not shown in FIG. 1) formed on the shell 11.

When a user uses the illumination cell 1, the user can attach the illumination cell 1 to the surface of a fixture, and make the battery 15 supply power to the LED 16 via the supply circuit arranged on the circuit board 14, so as to drive the LED 16 projecting an illumination light beam IL0. Hereafter, the illumination light beam IL0 can be projected out from the illumination cell 1 through the light-transmissible element 13 to provide a portable-type illumination to an external environment. When said power supplied by the battery is insufficient to drive the LED 16 normally projecting the illumination light beam IL0, the user can open the battery lid to replace the battery 15 with another one.

In the above application, although the development of the illumination cell 11 has successfully transferred the portable-type illumination to the versatile-type illumination, there are still three problems existing as follows.

Firstly, since the battery 15 is not a rechargeable battery, so that the battery 15 cannot be recharged. Even though, the battery is a rechargeable battery, the circuit board 14 is not disposed with a charging circuit. Therefore, it is still not able to directly charge the battery 15 when the battery is still assembled within the illumination cell 1.

Secondly, even though, the battery can be charged by an external charging module, an external power source with a charging loop is still a must. Once, a plurality of illumination cells 1 are used, it will be necessary to connect a plurality of charging loops, or additionally connect with at least one power distributor.

Thirdly, under the processes of charging, if the amount of the charging loops are not enough with respect to the amount of the illumination cells 1, the illumination cells not connected to any charging loop cannot be charged. Certainly, the illumination cells have insufficient power so as to not provide the specified illumination function to the external environment.

SUMMARY OF THE INVENTION

The problems intend being solved in the present invention and the objects of the present invention are described as follows:

Summarizing above description, since the conventional illumination cells exist three problems of: being not able to directly charge the battery when the battery is still assembled within the illumination cell; being necessary to additionally connect with charging loops; and being neither able to charge the battery nor able to provide illumination simultaneously when the amount of charging loops is not enough.

Thus, the primary object of the present invention provides an illumination cell having a base for assembling a plurality of illumination cells. Each illumination cell has a rechargeable power storage unit to supply power for projecting the illumination beam. Meanwhile, the illumination assembly is further arranged with a supply circuit for supplying power to drive the plural of illumination cells respectively projecting the illumination light beam and to charge the illumination cell, so as to simultaneously solve all the three problems as mentioned.

Means of the present invention for solving problems:

Means of the present invention for solving the problems as mentioned above provide an illumination cell comprising a base and at least one illumination cell. The base comprises a supply circuit for supplying an external power after connecting to a power source. The illumination cell is optionally connected to the base or removed from thereof, and includes a power storage unit stored with a storage power, a discharging circuit, and a charging circuit, wherein the power storage unit is electrically connected to the discharging circuit and the charging circuit. When the illumination cell is removed from the base, the storage power released from the power storage unit drives the illumination cell projecting an illumination light beam via the discharging circuit. When the illumination cell is assembled to the base, the supply circuit is electrically connected to the discharging circuit and the charging circuit respectively, so that the external power can drive the illumination cell projecting the illumination light beam and charge the power storage unit simultaneously.

In three applications of the preferred embodiment of the present invention, one or more illumination cell(s) can be assembled to a desk lamp frame, an illumination wall frame, and an illumination device frame to respectively be a desk lamp, an illumination wall, and an illumination device.

Effects of the present invention with respect to prior arts:

Making a comparison between the illumination cell of the present invention and the conventional illumination cell, the illumination cell of the present invention not only can solve the three problems as mentioned, but also can project a modulated illumination light beam complying with an actual illumination requirement by a method of connecting different kinds of illumination cells to the base. Thus, the illumination assembly can provide the versatile-type illumination.

Nevertheless, since the illumination cell of the present not only can be removed from the base to individually provide the portable-type illumination, but also can be assembled to the base to be the illumination assembly and provide versatile-type illumination. Furthermore, the illumination assembly can be assembled to the desk lamp frame, the illumination wall frame, the illumination device frame, and so on, so that the illumination assembly obviously broadens the application field with respect to the prior art.

The devices, characteristics, and the preferred embodiment of this invention are described with relative figures as follows.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Due to that the illumination cell as provided in accordance with the present invention not only can be removed from the base to individually provide the portable-type illumination, but also can be assembled to the base to be the illumination assembly and provide versatile-type illumination. Furthermore, the illumination assembly can be assembled to the desk lamp frame, the illumination wall frame, the illumination device frame, and so on, the combined applications are too numerous to be enumerated and described, so that we only disclose a preferred embodiment and six applications for representation.

Figure 1:
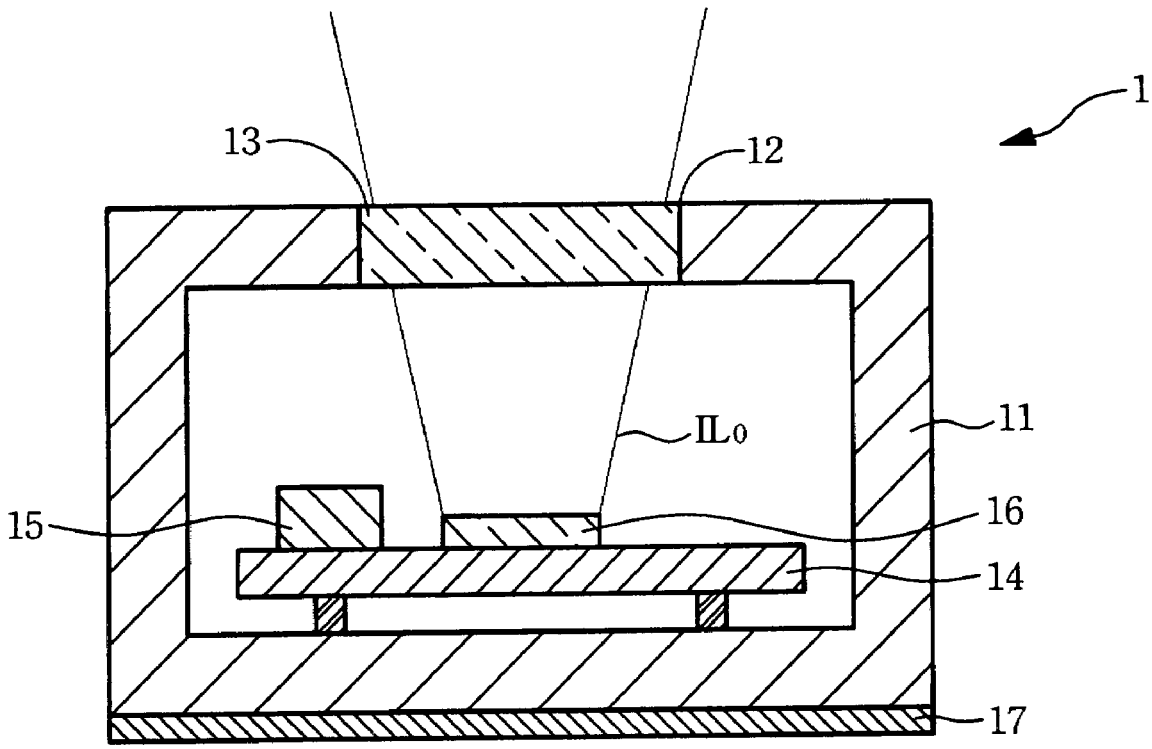
FIG. 1 (Prior Art)
FIG. 1 illustrates a sectional view of a conventional illumination cell.
Figure 2:
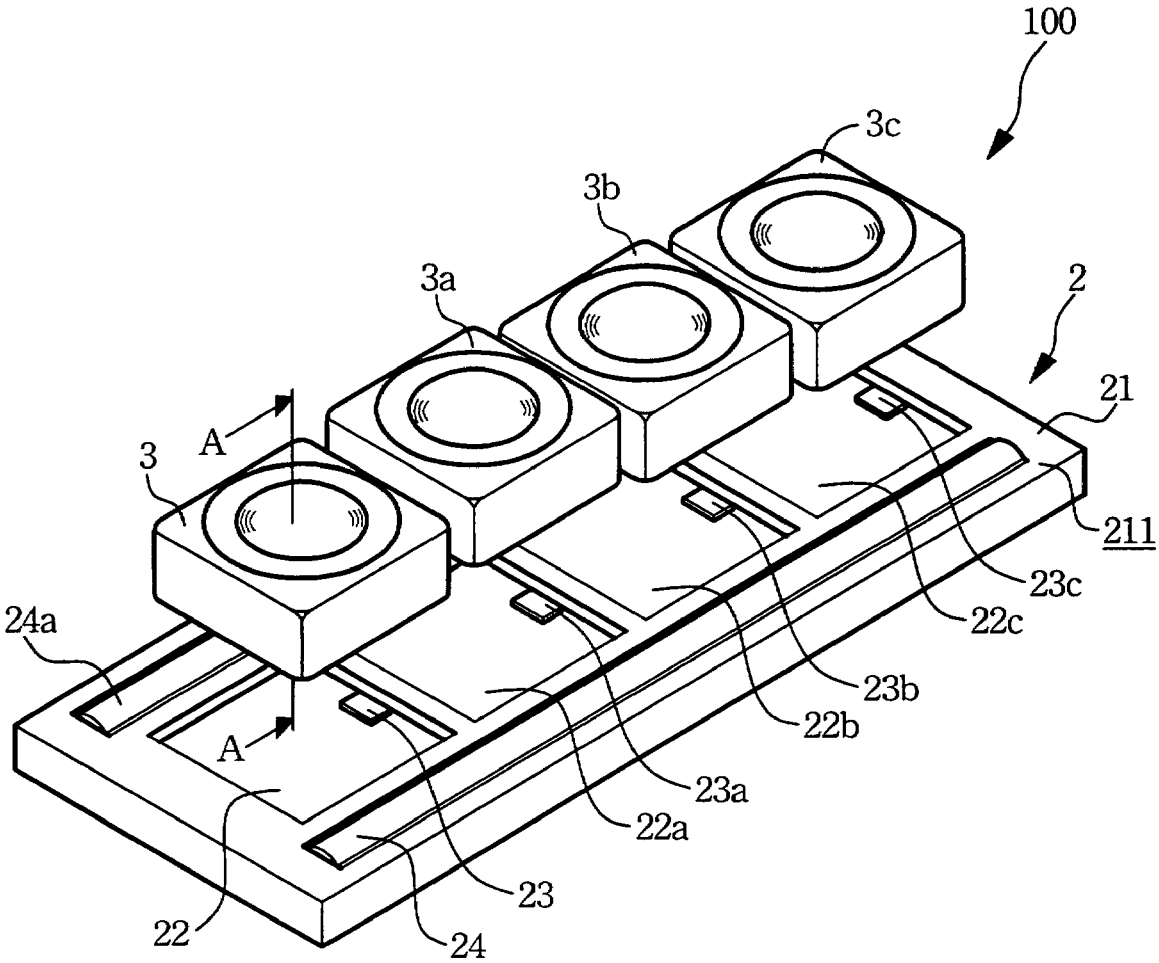
FIG. 2 illustrates four illumination cells are removed from a base in accordance with a preferred embodiment of the present invention.
Figure 3:
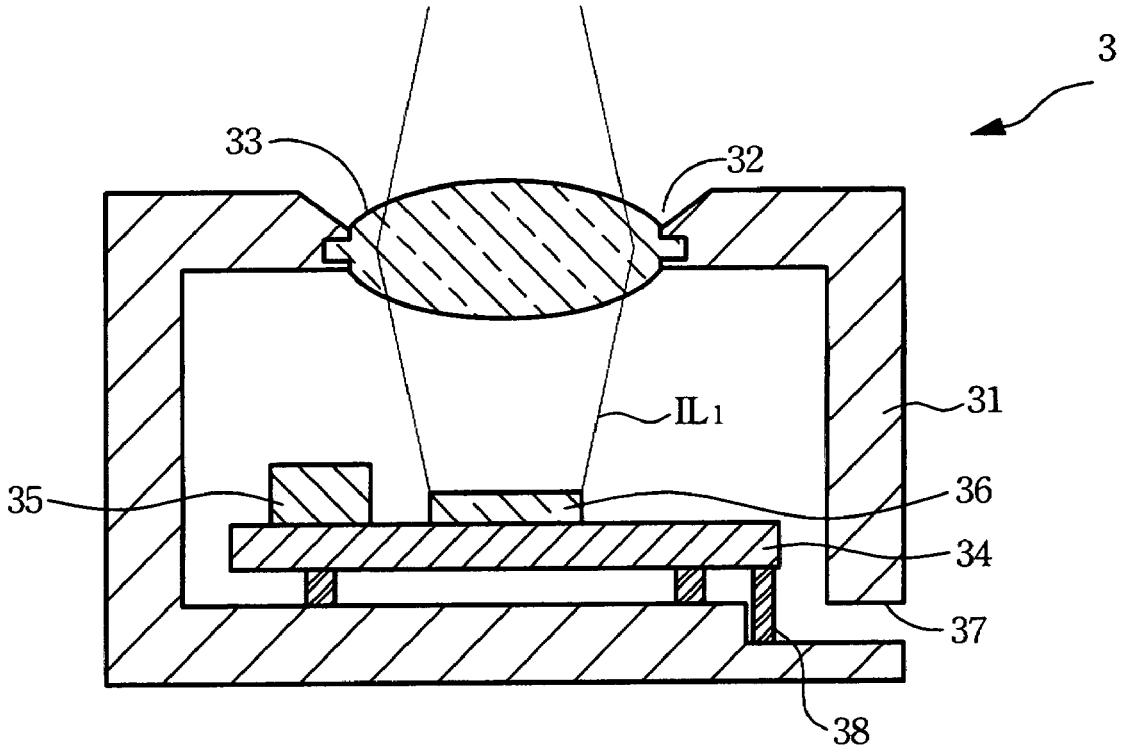
FIG. 3 illustrates a sectional view of the illumination cell along a line A-A of the FIG. 2.
Figure 4:
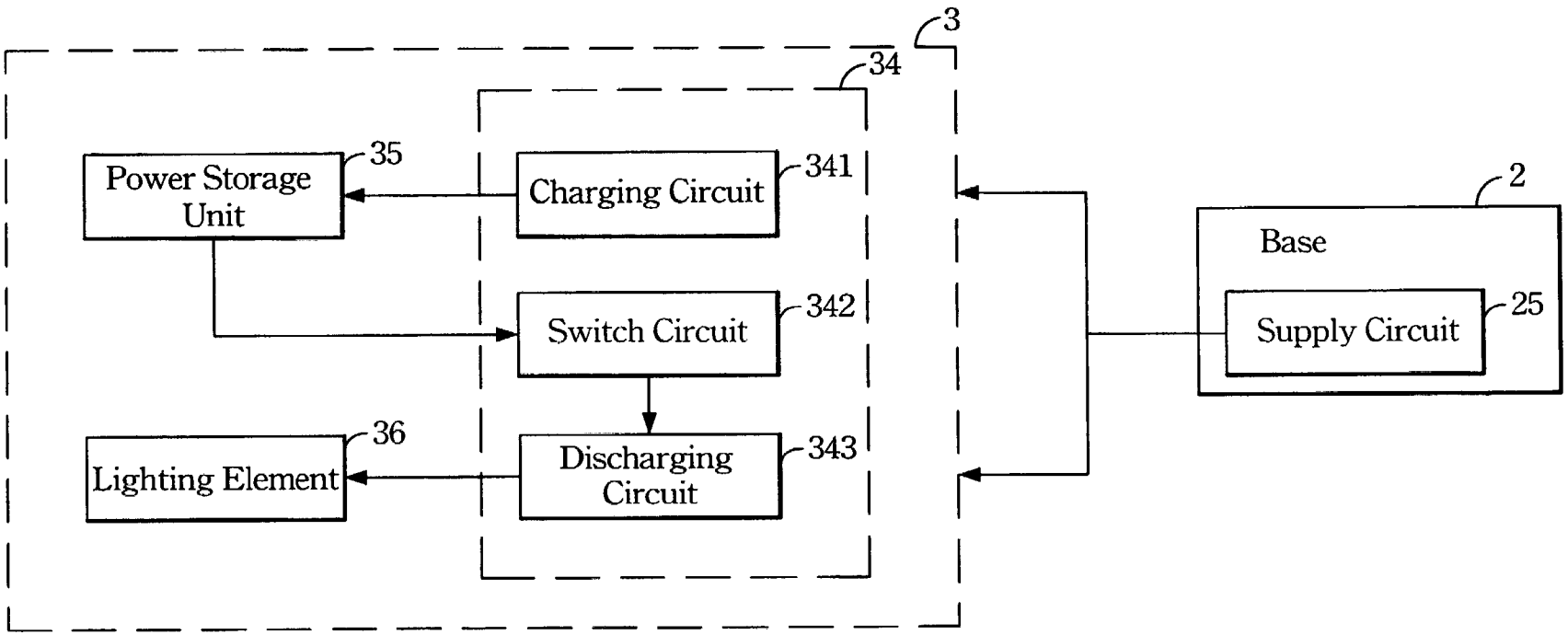
FIG. 4 is a block diagram illustrating the electrical connection relations between the base and the illumination cell.

Please refer to FIG. 2 to FIG. 4, wherein FIG. 2 illustrates four illumination cells are removed from a base in accordance with a preferred embodiment of the present invention, FIG. 3 illustrates a sectional view of the illumination cell along a line A-A of the FIG. 2, and FIG. 4 is a block diagram illustrating the electrical connection relations between the base and the illumination cell. An illumination assembly 100 includes a base 2, and four illumination cells 3, 3*a*, 3*b*, and 3*c*, wherein the four illumination cells 3, 3*a*, 3*b*, and 3*c* can be optionally connected to the base 2 or removed form thereof.

The base 2 includes a base body 21, four connection grooves 22, 22*a*, 22*b* and 22*c*, four pinch mechanisms 23, 23*a*, 23*b*, and 23*c*, a pair of operation elements 24 and 24*a*, and a supply circuit 25 (shown in FIG. 4). In the preferred embodiment, the four pinch mechanisms 23, 23*a*, 23*b*, and 23*c* are four pinch springs, the operation elements are a pair of flexible press bars.

The base body 21 has an arrangement surface 211, the four connection grooves 22, 22*a*, 22*b*, and 22*c* are four recessed structures recessed from the arrangement surface 211. The four pinch mechanisms 23, 23*a*, 23*b*, and 23*c* are respectively arranged within the four connection grooves 22, 22*a*, 22*b*, and 22*c*, and mechanically connected to the operation elements 24 and 24*a*. Meanwhile, the pinch mechanisms 23, 23*a*, 23*b*, and 23*c* are further electrically connected to the supply circuit 25.

The illumination cell 3 comprises a shell 31, an illumination opening 32, a light-transmissible element 33, a circuit interface 34, a power storage unit 35, a light element 36, a fix groove 37, and a conductive pin 38. In the preferred embodiment, the light-transmissible element 33 is a light-concentrated lens, the circuit interface 34 is a circuit board, the power storage unit 35 is a rechargeable battery stored with a storage power, and the lighting element 36 is a light emitting diode (LED).

The illumination opening 32 is formed on the shell 31, and the light-transmissible element 33 is fitted to the illumination opening 32. The circuit interface 34 is arranged within the shell 31, and arranged with a charging circuit 341, a switch circuit 342, and a discharging circuit 343, wherein the charging circuit 341 is electrically connected to the power storage unit 35 and the discharging circuit 343, the discharging circuit is electrically connected to the lighting element 36.

The fix groove 37 is formed on the shell 31 of the illumination cell 3. When the illumination shell 3 is assembled to the base 2, the fix groove 37 is located with respect to the pinch mechanism 23, and the conductive pin 38 is electrically connected to the charging circuit 341, the discharging circuit 343 and the pinch mechanism 23. Moreover, a battery lid (not shown) also can be provided to cover a battery opening (not shown) formed on the shell 31.

When a user removes the illumination cell 3 from the base 2 to individually provide portable-type illumination, the user can make power storage unit 35 electrically connect to the discharging circuit 343 via the switch circuit 342. Thus, the storage power stored in the power storage unit 35 can be released and transmitted via the discharging circuit 343 arranged on the circuit interface 34 to drive the lighting element 36 projecting an illumination light beam IL1. Following up, the illumination light beam IL1 can be projected out from the illumination cell 3 through the light-transmissible element 13 to provide a portable-type illumination to an external environment.

When the user uses the illumination assembly to provide a versatile-type illumination, the user can press the operation element 24 or 24*a* to make the pinch mechanisms 23, 23*a*, 23*b*, and 23*c* be contracted, and select one, two, three or all of the four illumination cells 3, 3*a*, 3*b*, and 3*c* to assemble to the connection groove(s) 22, 22*a*, 22*b*, and (or) 22*c*. When only the illumination cell 3 is assembled to the connection groove 22, the user can put the illumination cell 3 into the connection groove 22, and release the operation element 24 or 24*a* to make the pinch mechanism 23 be inserted into fix groove 37 of the illumination cell to pinch the illumination cell 3. Hereafter, the pinch mechanism can be electrically connected to the conductive pin 38, and further be electrically connected to the charging circuit 341 and the discharging circuit 343 via the conductive pin 38.

When the supply circuit 25 connects to a power source, an external power is provided to the charging circuit 341 and the discharging circuit 343. Meanwhile, the switch circuit 342 interrupts an electrical connection between the power storage unit 35 and the discharging circuit 343. Therefore, the external power can charge the storage unit 35 via the charging circuit 341, and simultaneously drive the lighting element 36 projecting the illumination light beam IL1 as shown in FIG. 3 via the discharging circuit 343.

From above description, under a general condition, when the storage power stored in the power storage unit 35 of the illumination cell 3 is insufficient, the illumination cell 3 can be charged without replacing battery, additionally connecting to the charge loop, or interrupting projecting the illumination light beam IL1. Therefore, the three problems as mentioned above can be solved. Only when the power storage capacity of the power storage unit 35 is insufficient, the user can open the battery lid to replace the power storage unit 35 with another one.

Figure 5:
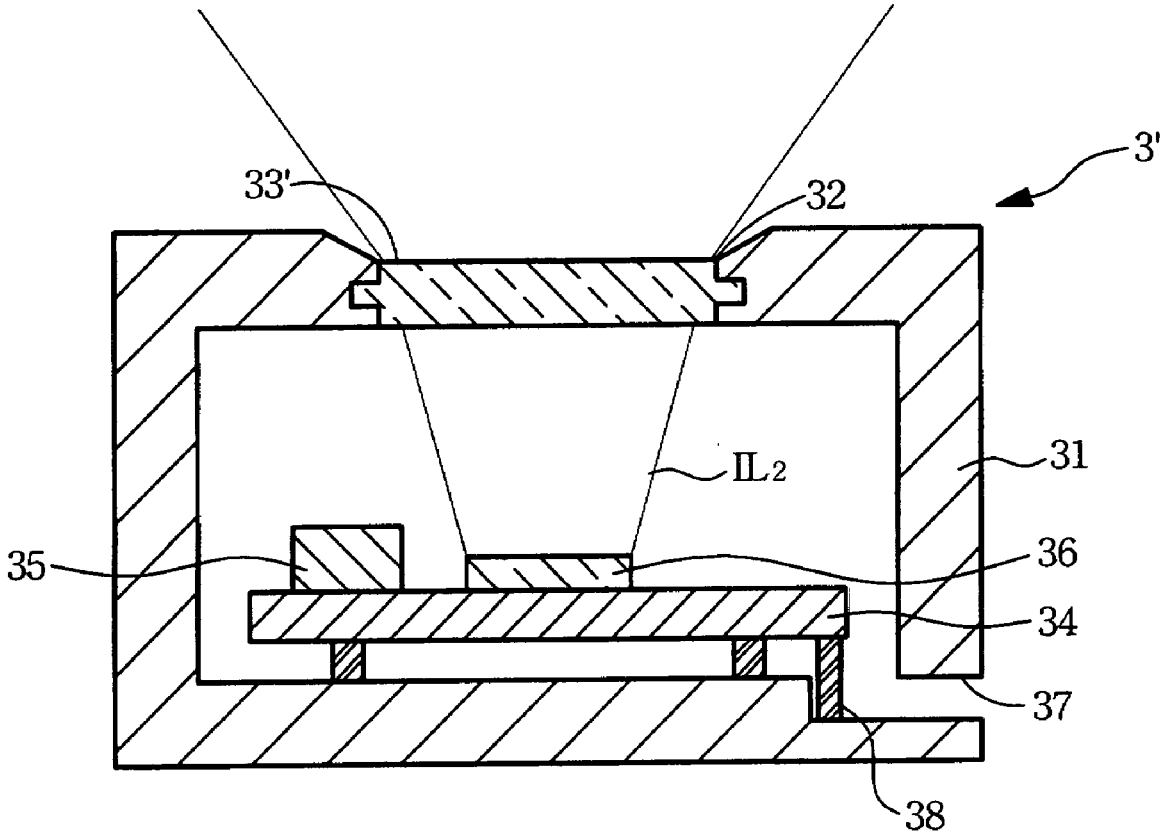
FIG. 5 illustrates a first application of the preferred embodiment of the present invention.

Please refer to FIG. 5, which illustrates a first application of the preferred embodiment of the present invention. In the first application of the preferred embodiment, another light-transmissible element 33' is fitted to the illumination opening 32 to replace the light-transmissible element 33. The light transmissible element 33' is an optical diffuser for diffusing an illumination light beam IL2 projected out from the illumination cell 3, so as to generate a performance of light-diffusing as shown in FIG. 5.

Figure 6:
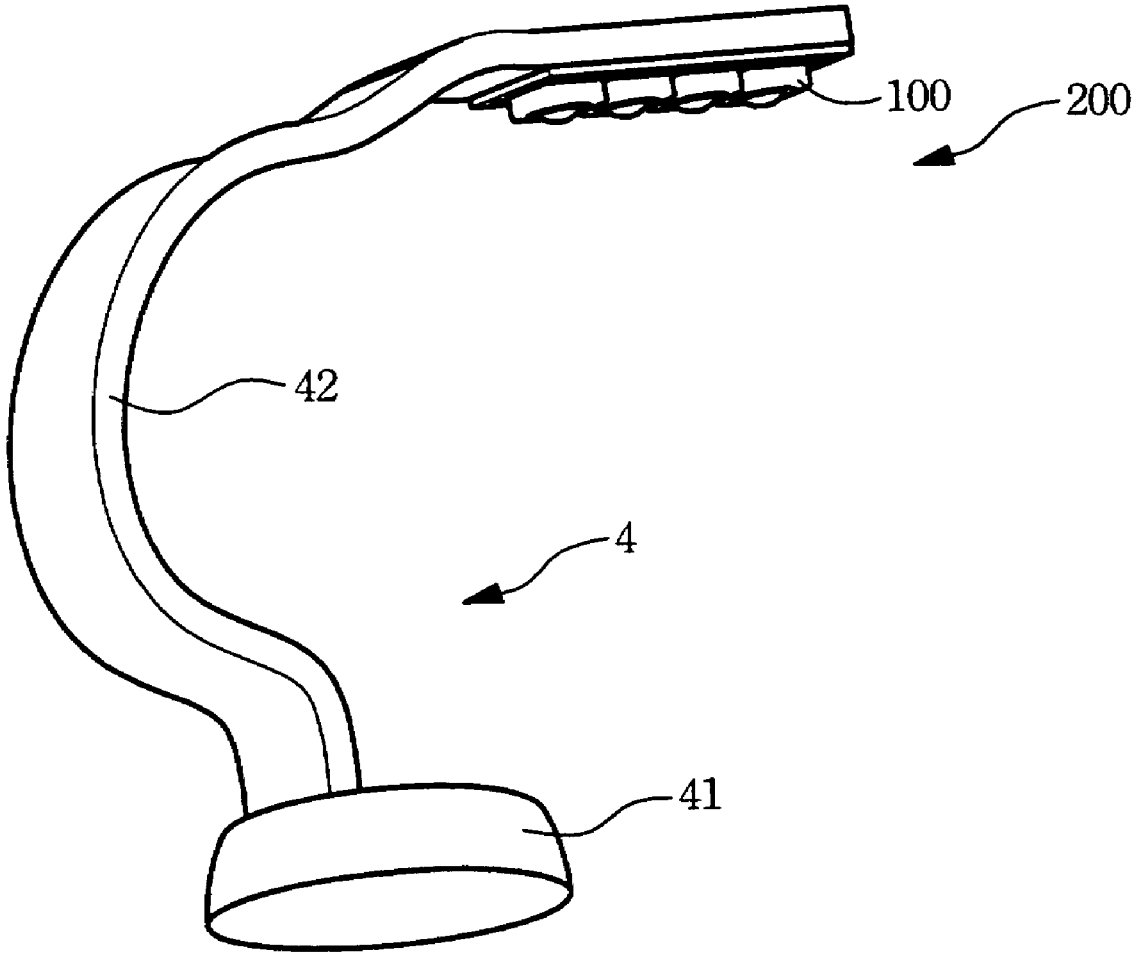
FIG. 6 illustrates a second application of the preferred embodiment of the present invention.

Please refer to FIG. 6, which illustrates a second application of the preferred embodiment of the present invention. As shown in FIG. 6, a desk lamp frame 4 includes a base 41 and a suspension arm 42, wherein the suspension arm 42 is extended from the base 41 to a free end. In the second application, the illumination assembly 100 is assembled to the suspension arm 42, neighbor to the free end, so as to assemble a desk lamp 200.

Figure 7:
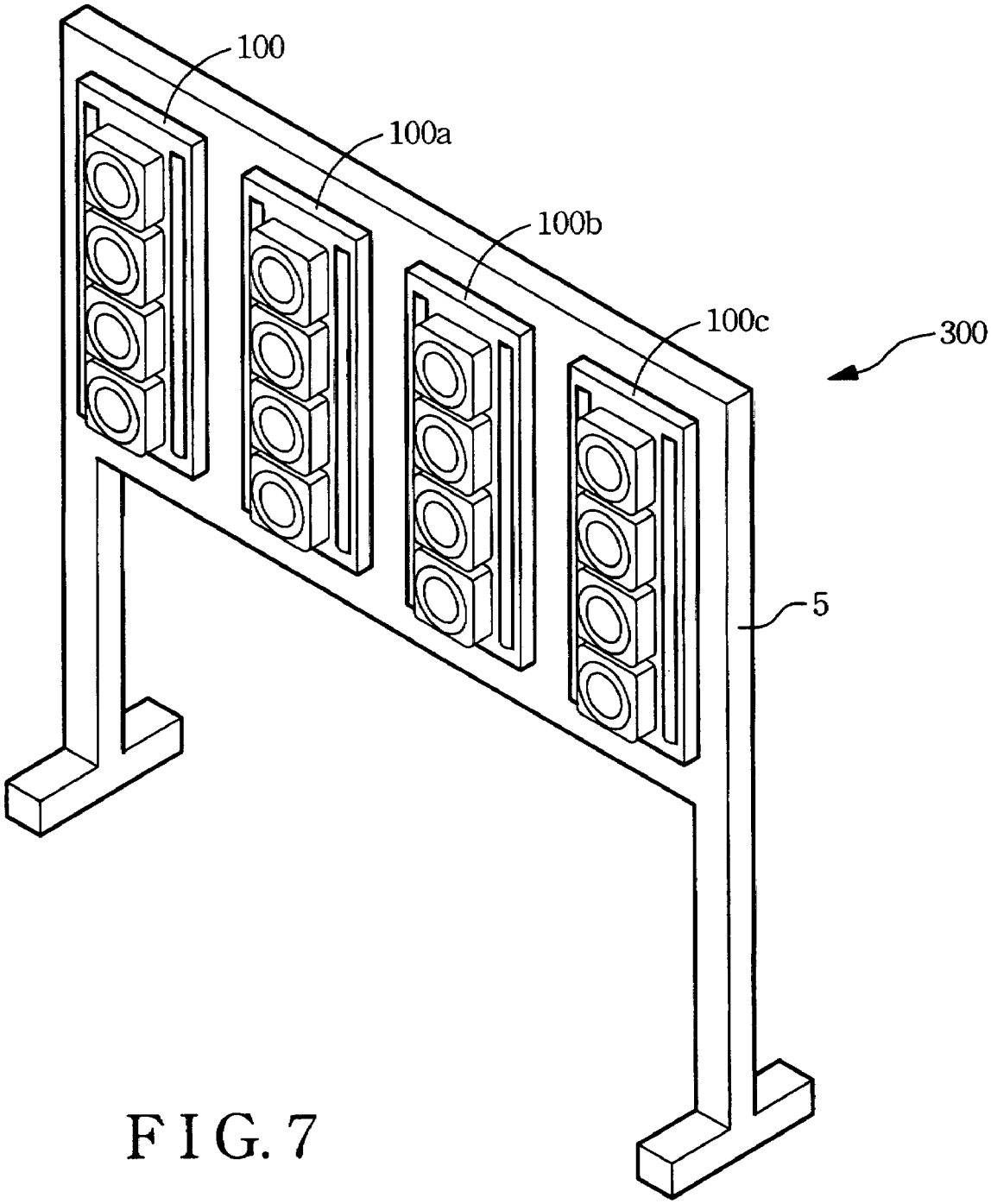
FIG. 7 illustrates a third application of the preferred embodiment of the present invention.

Please refer to FIG. 7, which illustrates a third application of the preferred embodiment of the present invention. In the third application, the illumination assembly 100 and other three illumination assemblies 100*a*, 100*b*, and 100*c* with the same structures are assembled to an illumination wall frame 5 to be an illumination wall 300.

Figure 8:
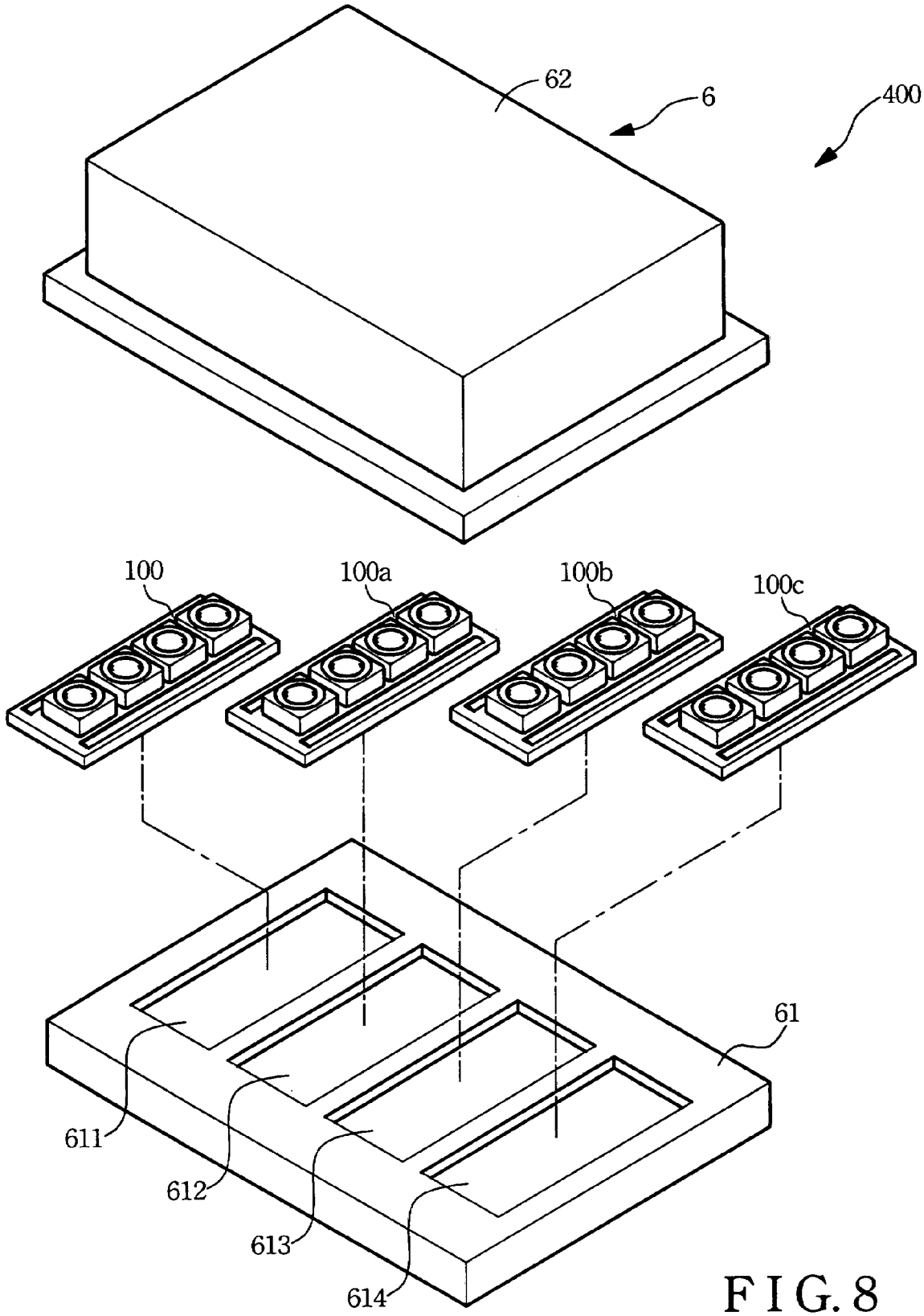
FIG. 8 illustrates a fourth application of the preferred embodiment of the present invention.

Please refer to FIG. 8, which illustrates a fourth application of the preferred embodiment of the present invention. As shown in FIG. 8, an illumination device frame 6 includes a fixture 61 and a light-transmissible shell matching to the fixture 61, and four connection grooves 611, 612, 613, and 614 are formed on the fixture 61. In the fourth application, the illumination assemblies 100, 100*a*, 100*b*, and 100*c* are respectively assembled to the connection grooves 611, 612, 613 and 614, and covered with the light-transmissible shell 62 to be an illumination device 400. Nevertheless, for complying with an actual illumination requirement, the light-transmissible shell 62 can be formed with a structure of light concentration, light polarization, light filtering, and/or anti-glare.

People skilled in related arts can easily realize that, in practice, for complying with another actual illumination requirement, the illumination light beams respectively projected from illumination cell 3, 3*a*, 3*b*, and/or 3*c* assembled to the base 2 can have different optical properties, such as frequency and lighting power, so as to modulate a modulated illumination light beam. With the difference of the illumination cell 3, 3*a*, 3*b*, and/or 3*c*, the modulated illumination light beam can present different optical properties.

Similarly, the modulated illumination light beams respectively projected from illumination assemblies 100, 100*a*, 100*b*, and/or 100*c* assembled to the illumination wall frame 5 of the illumination wall 300 and the illumination device frame 6 of the illumination device 400 have different optical properties, thus the illumination wall 300 and the illumination device 400 can provide the versatile-type illumination to external environment.

Besides, in the preferred embodiment, the illumination cell 3, 3*a*, 3*b*, and/or 3*c* are assembled to the base 2 through the pinch mechanisms, while in practice, they also can be assembled to the base 2 through the technologies of being sucked by a sucker, being fixed by a fitness between sliding elements, being absorbed by magnets, being attached by universal adhesive elements, and so on. Nevertheless, the illumination cell 3, 3*a*, 3*b*, and/or 3*c* also can be attached to any surface of specified elements via any of the technologies to individually provide illumination to external environment. Moreover, the illumination assemblies 100, 100*a*, 100*b*, and 100*c* also can be assembled to the suspension arm 42, the illumination wall 5 and the fixture 61 via any of the technologies.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An illumination assembly comprising:

a base having a supply circuit for supplying an external power after connecting to a power source;

at least one illumination cell being optionally assembled to the base or removed from thereof, and comprising:

a power storage unit stored with a storage power;

a discharging circuit electrically connected to the power storage unit;

a lighting element electrically connected to the discharging circuit so as to project an illumination light beam by the storage power released from the power storage unit via the discharging circuit when the illumination cell is removed from the base; and a charging circuit electrically connected to the storage unit;

wherein when the illumination cell is assembled to the base, the supply circuit is electrically connected to the discharging circuit and the charging circuit respectively so as to drive the lighting element projecting the illumination light beam, and simultaneously charge the power storage unit.

2. The illumination assembly as claimed in claim 1, wherein the base comprises at least one connection groove for connecting the illumination cell.

3. The illumination assembly as claimed in claim 2, wherein the connection groove further comprises at least one pinch mechanism arranged within the connection cell for assembling the illumination cell to the connection groove.

4. The illumination assembly as claimed in claim 3, wherein the illumination cell is formed with a fix groove for the pinch mechanism being inserted to pinch the illumination cell.

5. The illumination assembly as claimed in claim 3, wherein the pinch mechanism is a pinch spring electrically connected with the supply circuit.

6. The illumination assembly as claimed in claim 3, wherein the base comprises an operation element mechanically connected with the pinch mechanism for optionally operating the pinch mechanism to assemble the illumination cell to the base or remove from thereof.

7. The illumination assembly as claimed in claim 6, wherein the operation element is a flexible press bar.

8. The illumination assembly as claimed in claim 1, wherein the illumination cell further comprises a shell formed with an illumination opening.

9. The illumination assembly as claimed in claim 8, wherein the illumination cell further comprises a light-transmissible element fitted to the illumination opening, and the illumination light beam is projected out from the illumination cell through the light-transmissible element.

10. The illumination assembly as claimed in claim 9, wherein the light-transmissible element is a light-concentrated lens for concentrating the illumination light beam projected out from the illumination cell.

11. The illumination assembly as claimed in claim 9, wherein the light-transmissible element is an optical diffuser for diffusing the illumination light beam projected out from the illumination cell.

12. The illumination assembly as claimed in claim 1, wherein the illumination cell further comprises an electrical interface for arranging the discharging circuit and the charging circuit.

13. The illumination assembly as claimed in claim 12, wherein the electrical interface is further arranged with a switch circuit electrically connected between the power storage unit and the discharging circuit, and the switch circuit optionally interrupts or makes an electrical connection between the power storage unit and the discharging circuit when the illumination cell is respectively assembled to the base or removed from thereof.

14. The illumination assembly as claimed in claim 12, wherein the electrical interface is a circuit board.

15. The illumination assembly as claimed in claim 1, wherein the lighting element is a light emitting diode (LED).

16. The illumination assembly as claimed in claim 1, wherein the power storage unit is a rechargeable battery.

17. The illumination assembly as claimed in claim 1, further being connected to a desk lamp frame to be a desk lamp.

18. The illumination assembly as claimed in claim 1, further being connected to an illumination wall frame to be an illumination wall.

19. The illumination assembly as claimed in claim 1, further being connected to an illumination device frame to be an illumination device.

* * * * *